US007891516B2

(12) United States Patent
Takahashi

(10) Patent No.: US 7,891,516 B2
(45) Date of Patent: Feb. 22, 2011

(54) CONTAINER, PACKAGING BODY, AND METHOD OF MANUFACTURING CONTAINER

(75) Inventor: Hiroyuki Takahashi, Sodegaura (JP)

(73) Assignee: Idemitsu Unitech Co., Ltd., Tokyo (JP)

( * ) Notice: Subject to any disclaimer, the term of this patent is extended or adjusted under 35 U.S.C. 154(b) by 1196 days.

(21) Appl. No.: 10/552,145

(22) PCT Filed: Apr. 7, 2004

(86) PCT No.: PCT/JP2004/005035

§ 371 (c)(1),
(2), (4) Date: Sep. 14, 2006

(87) PCT Pub. No.: WO2004/089779

PCT Pub. Date: Oct. 21, 2004

(65) Prior Publication Data

US 2007/0164094 A1 Jul. 19, 2007

(30) Foreign Application Priority Data

Apr. 8, 2003 (JP) ..... 2003-104153

(51) Int. Cl.
*B65D 1/40* (2006.01)
*B65D 90/02* (2006.01)
*B65D 17/34* (2006.01)
*B65D 41/00* (2006.01)

(52) U.S. Cl. ..... 220/62.22; 220/359.1; 220/359.2; 220/359.3; 220/359.4; 229/5.84; 229/123.1; 229/125.35

(58) Field of Classification Search ..... 220/62.22, 220/359.1, 359.2, 359.3, 359.4; 229/5.84, 229/123.1, 125.35
See application file for complete search history.

(56) References Cited

U.S. PATENT DOCUMENTS 5,098,751 A * 3/1992 Tamura et al. ..... 428/35.8
5,178,293 A * 1/1993 Suzuki et al. ..... 220/359.3
5,281,453 A * 1/1994 Yamada et al. ..... 428/35.7
5,316,603 A * 5/1994 Akazawa et al. ..... 156/69

FOREIGN PATENT DOCUMENTS

| | | |
|---|---|---|
| JP | 26568/1988 | 2/1988 |
| JP | 5-67511 | 6/1993 |
| JP | 8-164973 | 6/1996 |
| JP | 2869136 | 12/1998 |
| JP | 2994957 | 10/1999 |

* cited by examiner

*Primary Examiner*—Anthony Stashick
*Assistant Examiner*—Madison L Wright
(74) *Attorney, Agent, or Firm*—Oblon, Spivak, McClelland, Maier & Neustadt, L.L.P.

(57) ABSTRACT

A container is thermoformed from a multilayer sheet, which includes a container body and a flange extending outward from a circumference of an opening of the container body. An end of the first layer extends over an edge of a peeled surface toward a bottom side on an outer end surface of the flange. When a lid is heat-sealed to the flange of the container, even if a seal resin is melted and flowed toward the end surface of the flange, since the edge of the peeled surface is covered with the end of the first layer, the seal resin will not adhere to the edge of the peeled surface.

6 Claims, 6 Drawing Sheets

CONTAINER, PACKAGING BODY, AND METHOD OF MANUFACTURING CONTAINER

TECHNICAL FIELD

The present invention relates to a container that is molded from a multilayer sheet, the container satisfying both sealing performance and easy-open performance, a packaging body including the container, and a manufacturing method of the container.

BACKGROUND ART

Conventionally, for packaging various kinds of foods such as jelly and pudding, a packaging body including a container and a lid has been generally used. The container used for the packaging body is thermoformed, and after the container is filled with food or the like, the lid is heat-sealed (welded) to a flange extending outward from a circumference of an opening of the container.

The packaging body is preferably heat-sealed firmly in terms of keeping quality of a content and transportation (sealing performance). However, in terms of usability in opening the lid to use the content, the lid is desired to be easily opened (easy-open performance). Therefore, there has been a demand for a packaging body satisfying the sealing performance and the easy-open performance as contradictory performances described above.

In order to satisfy such demand, there has been suggested a method as shown in FIG. 9, where a container 100 is formed from a multilayer sheet and an innermost layer 100A of a flange 101 and a lid 7 are heat-sealed to each other, then when the lid 7 is peeled off, layer peeling is generated between the innermost layer 100A and an adjacent layer 100B adjacent to the innermost layer 100A to cause the innermost layer 100A to be peeled off with the lid 7 (see, for instance, JP-B-5-67509, pages 1 to 4, FIGS. 1 and 2, etc.).

Although the method is an excellent packaging method, it becomes difficult to peel off the innermost layer 100A by layer peeling in some cases, where the heat-sealing is performed with high temperature and high pressure to enhance heat-sealing strength between the lid 7 and the innermost layer 100A, and a seal resin is melted and flowed to an end surface of the flange 101 depending on resin types of the inner most layer 100A and the lid 7, melt viscosities of the resins, etc., causing the seal resin to cover an edge of a peeled surface H formed on the adjacent later 100B.

Therefore, a heat-seal condition has to be controlled in a narrow range to obtain sufficient sealing performance and easy-open performance.

DISCLOSURE OF THE INVENTION

An object of the present invention is to provide a container that can maintain an easy-open performance even when a lid is heat-sealed with high temperature and high pressure to enhance a sealing performance, a packaging body and a manufacturing method.

A container according to an aspect of the present invention which is molded from a multilayer sheet having a peeled surface on an inner layer, includes: an opening from which a content is filled; and a flange extending outward from a circumference of the opening, in which on an outer end surface of the flange, an end of an innermost layer disposed on an inner side of the container including an upper surface of the flange extends over an edge of the peeled surface formed on the flange toward a bottom side of the container.

The peeled surface may be formed by layer peeling generated between the innermost layer and an adjacent layer adjacent to the innermost layer, or by cohesive failure generated within the adjacent layer. In addition, the peeled surface may be formed by cohesive failure generated within the innermost layer.

For instance, in a case where the layer peeling is generated between the innermost layer and the adjacent layer, by peeling off the lid having been heat-sealed to the innermost layer of the flange of the container, the innermost layer is peeled off with the lid. In a case where the cohesive failure is generated within the inner most layer, by peeling off the lid, the failure occurs within the innermost layer to cause the innermost layer to be peeled off with the lid. Further, in a case where the cohesive failure is generated within the adjacent layer, by peeling off the lid, the innermost layer having been heat-sealed to the lid is peeled off with the adjacent layer.

Note that, the peeled surface herein is a surface formed along an extending direction of the flange, which does not include, for instance, a surface that is formed when the end of the innermost layer extending toward a bottom side of the container is peeled off from the adjacent layer in a case where the layer peeling is generated between the innermost layer and the adjacent layer.

In a case with the layer peeling generated between the innermost layer and the adjacent layer, peeling strength of the layer peeling is preferably around 3 to 15 N/15 mm, and thus it is conceived that, for instance, the innermost layer is formed by a layer containing a polyethylene resin, while the adjacent layer is formed by a layer containing a resin composition of a polypropylene resin and a polyethylene resin in the proportion of 50:50 to 97:3.

In a case with the cohesive failure generated within the adjacent layer or the innermost layer, when a peeling test is conducted with the adjacent layer or the innermost layer being firmly adhered to another film having proper strength to cause failure generated within the innermost layer or adjacent layer, the peeling strength is preferably 25 N/15 mm or smaller (JIS K 6854).

In order to generate the cohesive failure within the adjacent layer or the innermost layer, the adjacent layer and the innermost layer each may be formed by a layer containing a polyolefin resin, an elastomer with modulus of elasticity of, for instance, 200 MPa or smaller, preferably 150 MPa or smaller, and a flexible resin or a non-compatible resin.

The flexible resin and the elastomer are preferably contained in a polyolefin resin composition by around 3 to 50 wt %.

There is no limitation for the polyolefin resin composition, examples of which include a polypropylene resin such as a homopolypropylene, a random polypropylene and a block polypropylene, and a polyethylene resin such as a high-density polyethylene, a high-pressure process low-density polyethylene and a straight-chain low-density polyethylene.

As the flexible resin, for instance, an ethylene-polar vinyl compound copolymer can be exemplified. For instance, there can be exemplified an ethylene-acrylic acid copolymer (EAA), an ethylene-methylacrylate copolymer (EMA), an ethylene-methacrylic acid copolymer (EMAA), an ethylene-methylmethacrylate copolymer (EMMA), an ethylene-ethylacrylate copolymer (EEA), an ethylene-ethylacrylate-maleic acid anhydride copolymer (EEA-MAH), a known ethylene-acrylic acid copolymer such as an ionomer resin, an ethylene-vinyl acetate copolymer and a styrene graft polypropylene.

Examples of the elastomer include an olefin elastomer (e.g. copolymer of an amorphous ethylene and α-olefin such as propylene and butane, with density of 900 kg/m$^3$ or smaller), a styrene elastomer (a styrene-butadiene block copolymer, a styrene-butadiene random copolymer, etc.) and a hydrogenated material of the above.

According to the aspect of the invention, since the end of the innermost layer extends over the edge of the peeled surface toward the bottom side of the container, the edge of the peeled surface is not exposed on the outer end surface of the flange. Thus, in heat-sealing the lid to the flange, even when the seal resin is melted and flowed to the end surface of the flange, the seal resin does not adhere to the edge of the peeled surface, so that degradation of the opening performance due to the melted and flowed seal resin can be prevented, thus maintaining the easy-open performance.

Further, since the easy-open performance can be maintained even when the seal resin is deposited to the end surface of the flange, the heat-sealing can be performed with high temperature and high pressure, thus ensuring the high sealing performance.

According to the aspect of the present invention, it is preferable that an extending dimension of the end of the innermost layer of the flange is no less than 1.2 times as large as a distance between an upper surface of the innermost layer and the peeled surface of the flange.

By providing the end of the innermost layer with the extending dimension being no less than 1.2 times as large as the distance between the upper surface of the innermost layer and the peeled surface, the seal resin can be securely prevented from depositing to the edge of the peeled surface.

At this time, it is preferable that: the peeled surface is formed by layer peeling generated between the innermost layer and an adjacent layer adjacent to the innermost layer or by cohesive failure generated within the adjacent layer; and a ringed notch is formed along the opening on the innermost layer of the flange.

Since the ringed notch is formed on the innermost layer along the opening, when the lid having been welded to the container is peeled off, a part on the outer circumferential side of the notch of the innermost layer is easily peeled off with the lid, thereby ensuring the easy-open performance.

A packaging body according to another aspect of the present invention includes: any one of the containers described above; and a lid that is welded to the flange of the container.

Since the packaging body includes any of the containers described above, an advantage in which the easy-open performance can be maintained even when the lid is heat-sealed to the container with high temperature and high pressure to enhance the sealing performance can be obtained.

According to the aspect of the present invention, it is preferable that a seal resin welding the lid to the flange is melted and flowed to an outer surface of the end of the innermost layer at least on an opening part of the lid.

With the arrangement, even when the lid is heat-sealed to the container with high temperature and high pressure and the seal resin is melted and flowed to the outer surface of the end of the innermost layer, since the edge of the peeled surface is covered with the end of the innermost layer, opening of the packaging body will not become difficult due to the melted and flowed seal resin.

According to the aspect of the present invention, it is preferable that: a ringed notch is formed on the flange of the container; and the lid is welded to an outer circumferential side of the notch with a space of 0.2 mm or more.

When the inner pressure of the packaging body increases, a stress concentrates on an inner circumferential part of heat-sealed parts of the lid and the flange, but since the lid is welded to an outer circumferential side of the notch with a space of 0.2 mm, the stress is hardly applied to the notch. Therefore, the packaging body with excellent pressure resistance can be obtained.

Further, it is preferable that: the lid includes an opening tab; the flange of the container and the lid are welded by a first seal part having a predetermined width and formed to enclose the opening and a second seal part formed within an area of the first seal part to enclose the opening along the first seal part, the second seal part having a width narrower than that of the first seal part; and a seal resin of the second seal part is melted and flowed to the outer surface of the end of the innermost layer of the flange at a position corresponding to the opening tab of the lid.

Here, a width of the first seal part is preferably around 2 to 20 mm, more preferably around 3 to 10 mm. A width of the second seal part is preferably around 0.5 to 6 mm, more preferably, around 1 to 4 mm.

Since the flange and the lid are welded by the first seal part formed to enclose the opening and the second seal part formed within the area of the first seal part, the high sealing performance of the packaging body can be ensured.

Since the seal resin of the second seal part is melted and flowed to the end surface of the innermost layer of the flange at the position corresponding to the opening tab, and the second seal part is formed within the area of the first seal part, a force in opening is transmitted to the area of the first seal part, allowing the lid to be easily opened.

A manufacturing method of a container according to still another aspect of the present invention, which is molded from a multilayer sheet having a peeled surface on an inner layer and includes: a container body having an opening from which a content is filled; and a flange extending outward from a circumference of the opening of the container body with the peeled surface being formed, includes: forming the container body from the multilayer sheet; and setting a cutting die on a surface opposite to an innermost layer located on an inner side of the container body to die-cut the multilayer sheet at an outer circumference of a part corresponding to the flange.

Here, the outer circumference of the flange may be die-cut by moving the cutting die closer to the multilayer sheet or by supporting the molded multilayer sheet and moving the sheet closer to the cutting die.

According to the aspect of the invention, an outer side of a part corresponding to the flange of the multilayer sheet is supported by a support table or the like disposed on the innermost layer side of the multilayer, and the cutting die is disposed on an outermost layer side of the multilayer sheet at the part corresponding to the flange. Then, the multilayer sheet is sandwiched by the cutting die and the support table or the like to cut out the outer circumference of the flange.

With the arrangement, by disposing the cutting die on a side opposite to the innermost layer of the container body to die-cut the outer circumference of the flange, on the outer end surface of the flange, the end of the innermost layer extends over the edge of the peeled surface to be formed on the flange toward the bottom side of the container. Since the edge of the peeled surface to be formed on the flange is covered with the end of the innermost layer, even when the seal resin is melted and flowed in welding the lid to the flange of the container, the seal resin does not adhere to the edge of the peeled surface. Thus, the melted and flowed seal resin does not impede the opening, and the lid and the container can be heat-sealed with high temperature and high pressure, so that the container having high sealing performance while maintaining the easy-open performance under wide sealing condition can be manufactured.

At this time, it is preferable that an outer side of the part corresponding to the flange of the multilayer sheet is supported and the cutting die is actuated.

With the arrangement, by supporting the outer side of the part corresponding to the flange of the multilayer sheet and actuating the cutting die, the multilayer sheet is not loosened, thereby accurately die-cutting the container.

According to the aspect of the present invention, it is preferable that, when the outer side of the part corresponding to the flange of the multilayer sheet is supported, the part is supported by biasing from a side opposite to the innermost layer.

With the arrangement, when the outer side of the part corresponding to the flange of the multilayer sheet is supported, by biasing and supporting the multilayer sheet from the side opposite to the innermost layer, the supported part can be quickly released after die-cutting, which allows successive die-cutting and enhancing manufacturing efficiency.

Further, it is preferable that the opening of the container body formed from the multilayer sheet is faced downward and the cutting die is moved downward to die-cut the container body.

With the arrangement, by setting the multilayer sheet so that the opening is faced downward and moving the cutting die downward to perform die-cutting, the die-cut container drops due to the self-weight. During the dropping, by replacing the multilayer sheet with a new one to be die-cut, the die-cutting step can be performed successively, thereby enhancing the manufacturing efficiency.

BEST MODE FOR CARRYING OUT THE INVENTION

An embodiment of the present invention will be described below with reference to the attached drawings.

Figure 1:
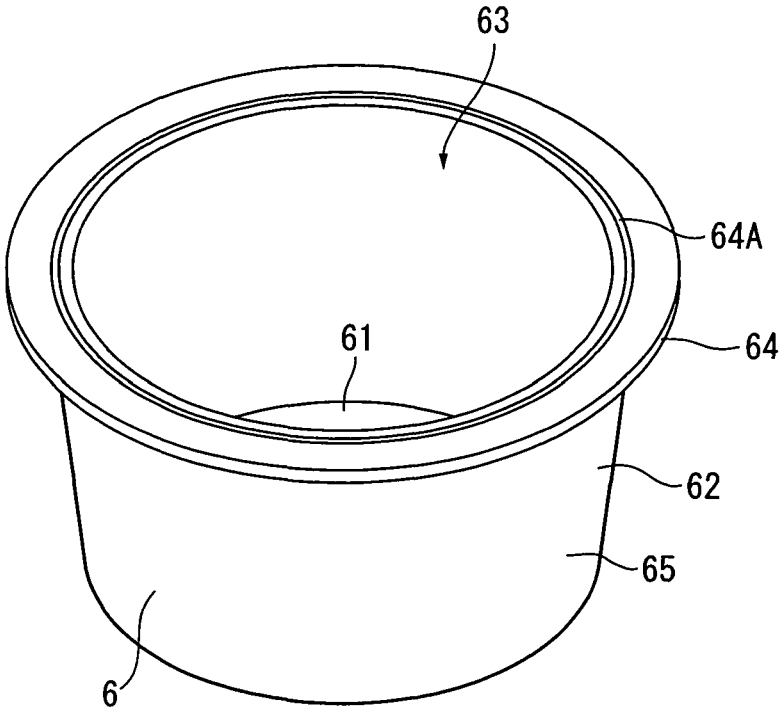
FIG. 1 is a perspective view showing a container according to an embodiment of the present invention.
Figure 2:
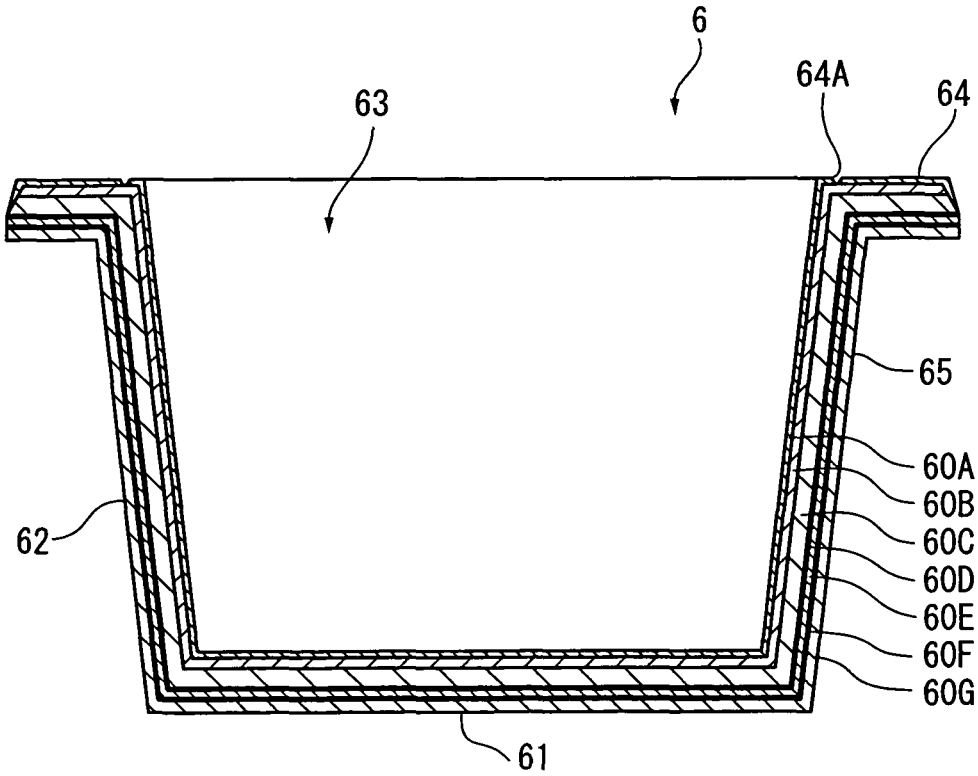
FIG. 2 is a cross section of the container shown in FIG. 1.

FIG. 1 shows a perspective view of a container 6 according to the embodiment of the present invention. FIG. 2 shows a cross section of the container 6.

The container 6 generally contains various kinds of foods such as jelly and pudding, which includes: a container body 65 having a circular bottom side 61, a cylindrical lateral side 62 that is upright from and integrated with the bottom side 61 and an opening 63 positioned opposite to the bottom side 61; and a flange 64 integrally molded with the container body 65.

The container 6 is thermoformed from a multilayer sheet 2 having seven layers (see FIG. 8, though a layer structure of the multilayer is not shown in FIG. 8), the seven layers including a first later (innermost later) 60A, a second layer 60B, a third layer 60C, a fourth layer 60D, a fifth layer 60E, a sixth layer 60F and a seventh layer 60G in order starting from the inner side of the container 6.

Since the first layer (innermost layer) 60A is heat-sealed to the lid 7 (described later), the first layer 60A may be formed by any layer containing a thermoplastic resin which is heat-sealable, and a polyolefin resin can be employed, for instance. In the present embodiment, the first layer 60A contains a polyethylene resin.

The second layer 60B is an adjacent layer adjacent to the innermost layer, and layer peeling is generated between the first layer 60A and the second layer 60B when the lid 7 (described alter) is peeled off. Thus, the second layer 60B may employ any resin as long as the resin causes the layer peeling to be generated between the first layer 60A and the second layer 60B, which may contain, for instance, a resin composition containing a polypropylene resin and a polyethylene resin in the proportion of 50:50 to 97:3.

The third layer 60C is a base material layer, which contains, for instance, a polypropylene resin.

The fourth layer 60D is an adhesive layer for providing adhesion between the third layer 60C and the fifth layer 60E, which contains an adhesive resin.

The fifth layer 60E is a gas barrier layer, which contains, for instance, an ethylene-vinylalcohol copolymer.

The sixth layer 60F is an adhesive layer for providing adhesion between the fifth layer 60E and the seventh layer 60G, which contains an adhesive resin in a manner same as the fourth layer 60D.

The seventh layer 60G is an outermost layer of the container 6, which contains, for instance, a polypropylene resin.

Figure 3:
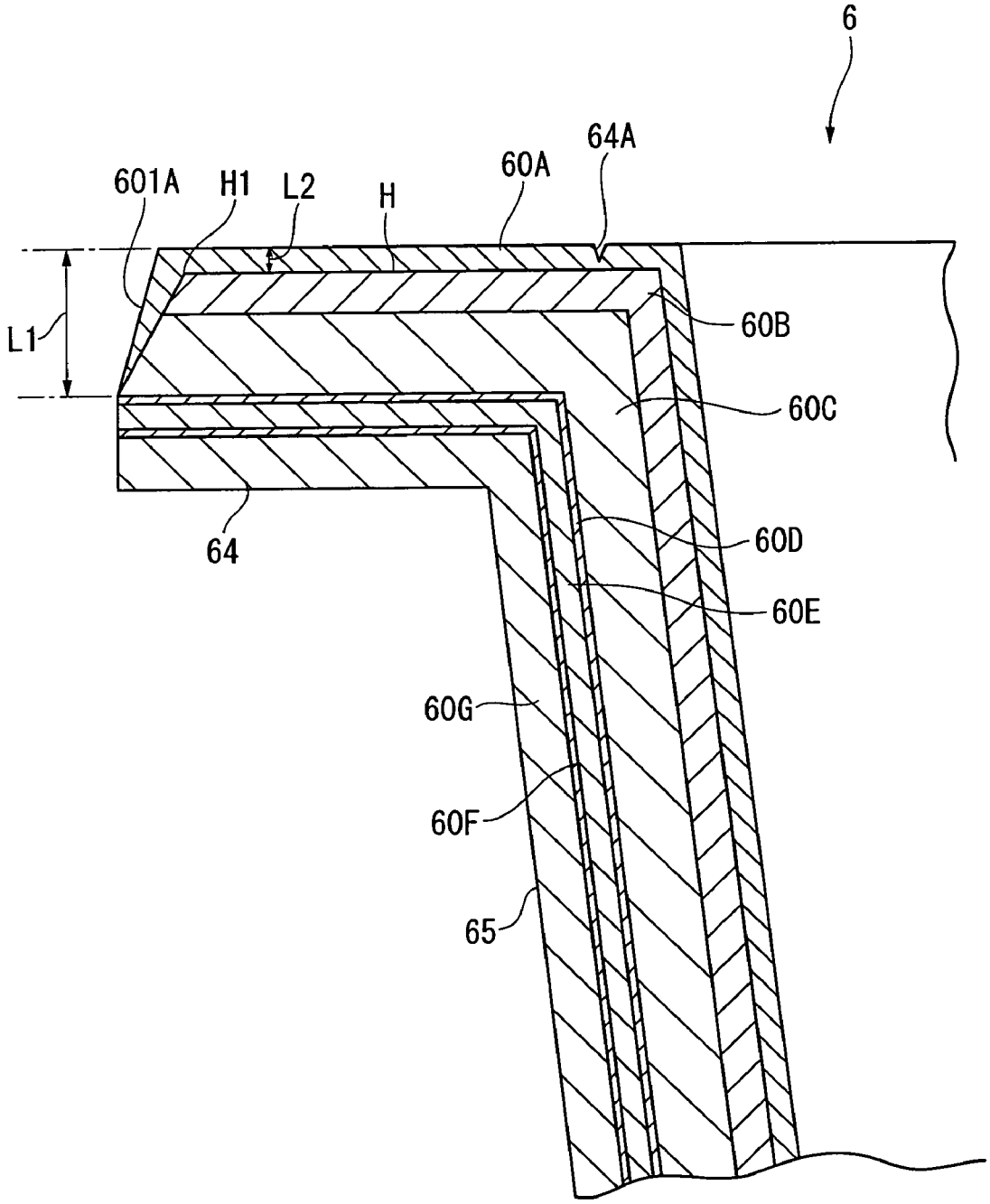
FIG. 3 is an illustration showing a primary part of the container in an enlarged manner.

The flange 64 extends outward from the circumference of the opening 63, and a notch 64A having a substantially V-shaped cross section is formed on the first layer 60A of the flange 64 to enclose the opening 63 as shown in FIG. 3.

As shown in FIG. 3, on an outer end surface of the flange 64, an end 601A of the first layer 60A extends toward the bottom side 61, and a tip of the end 601A in an extending direction extends over an edge H1 of a peeled surface H formed between the first layer 60A and the second layer 60B to reach the third layer 60C. The extending dimension L1 of the end 601A is no less than 1.2 times as large as a distance L2 between the upper surface of the first layer 60A and the peeled surface H formed on the upper surface of the second layer 60B.

Next, a packaging body 1 using the container 6 described above will be described below referring to FIGS. 4 to 7.

Figure 4:
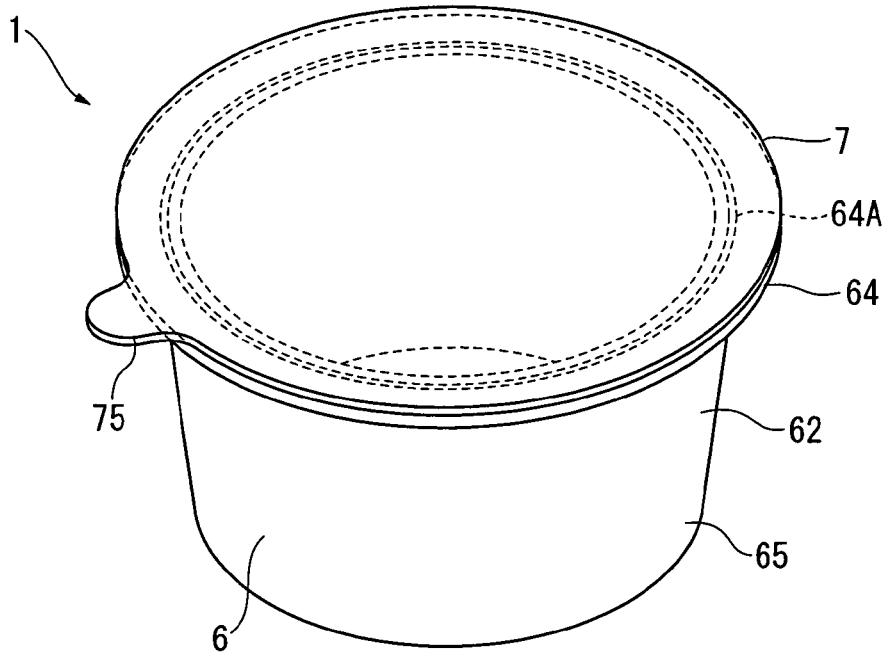
FIG. 4 is a perspective view showing a packaging body of the invention.

As shown in FIG. 4, the packaging body 1 has the container 6 and the lid 7 that is heat-sealed to the flange 64 of the container 6 to cover the opening 63.

The lid 7 is molded from a sheet into a substantially circular shape, which has a substantially semicircular opening tab 75 protruding outward from the lid 7.

Figure 5:
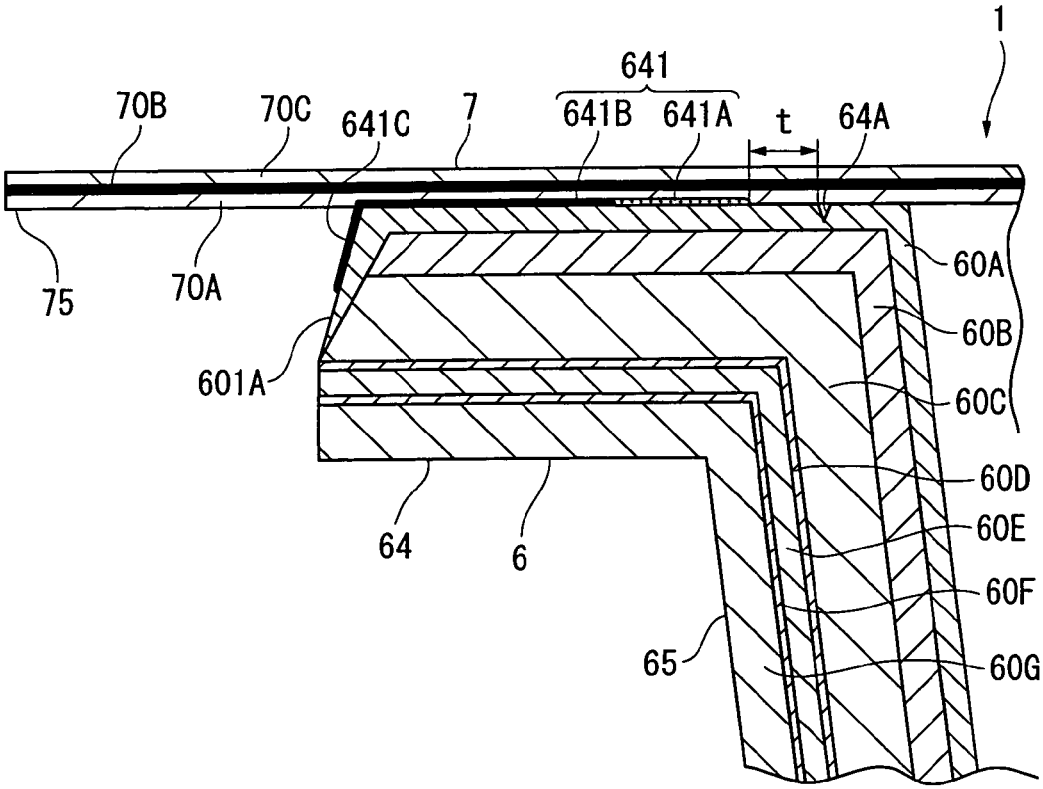
FIG. 5 is a cross section showing a primary part of the packaging body.

As shown in FIG. 5, the lid 7 includes a sealant layer 70A heat-sealed to the flange 64 and a base material layer 70C adhering to the sealant layer 70A via an adhesive resin layer 70B.

The sealant layer 70A may be formed by any resin layer that is heat-sealable to the flange 64, which contains, for instance, a straight-chain low-density polyethylene resin. The base material layer 70C contains, for instance, a polyethylene terephthalate resin.

Figure 6:
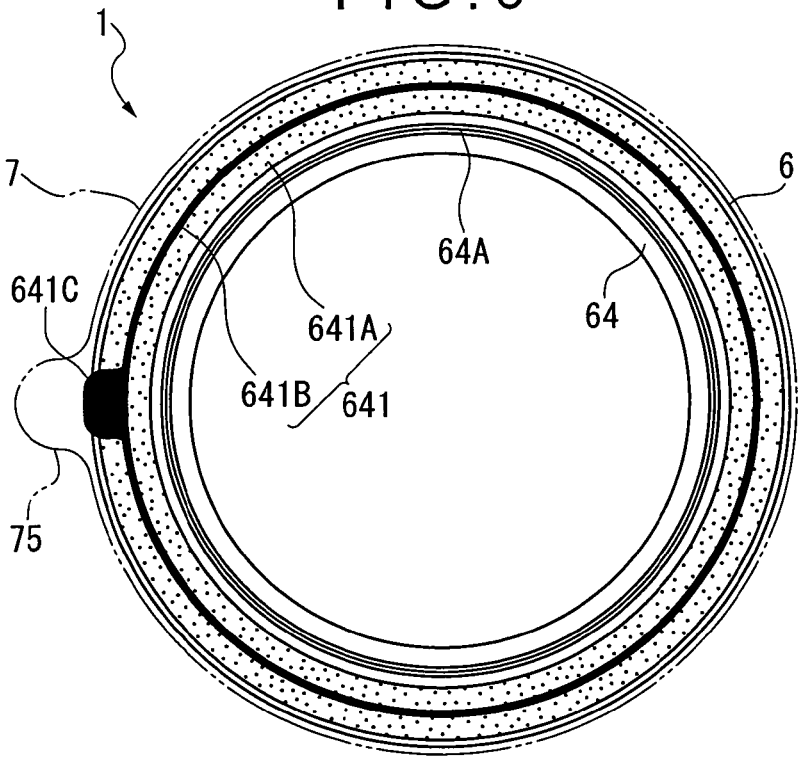
FIG. 6 is a plan view showing an upper surface of the lid of the packaging body.

When the lid 7 is welded to the flange 64 of the container 6, a heat-seal part 641 is formed on the upper surface (first layer 60A) of the flange 64. As shown in FIG. 6, the heat-seal part 641 includes a ringed first seal part 641A having a predetermined width and formed to enclose the opening 63 and a ringed second seal part 641B formed within an area of the first seal part 641A to enclose the opening 63 along the first seal part 641A.

As shown in FIG. 5, the first seal part 641A is formed on the outer circumferential side of the notch 64A with a space of 0.2 mm or more, preferably around 0.5 to 5 mm (i.e., a distance t between an inner edge of the first seal part 641A and the notch 64A is 0.2 mm or more, preferably around 0.5 to 5 mm), which means that the lid 7 is welded to the flange 64 on the outer circumferential side of the notch 64A with the space of 0.2 mm or more.

The second seal part 641B is formed along the central part of the first seal part 641A in the width direction, the width of which is narrower than that of the first seal part 641A. For instance, the width of the first seal part 641A is 2 to 20 mm, preferably 3 to 10 mm, while the width of the second seal part 641B is 0.5 to 6 mm, preferably 1 to 4 mm.

The second seal part 641B has a protruding seal part 641C protruding outward at a position corresponding to the opening tab 75 of the lid 7. The protruding seal part 641C is formed by a seal resin melted and flowed from the second seal part 641B. The protruding seal part 641C extends toward a back side of the opening tab 75 and further extends to reach an end surface of the end 601A of the first layer 60A of the container 6.

Incidentally, although the protruding seal part 641C is formed only at one part in the present embodiment, a plurality of protruding seal parts may be formed.

Figure 7:
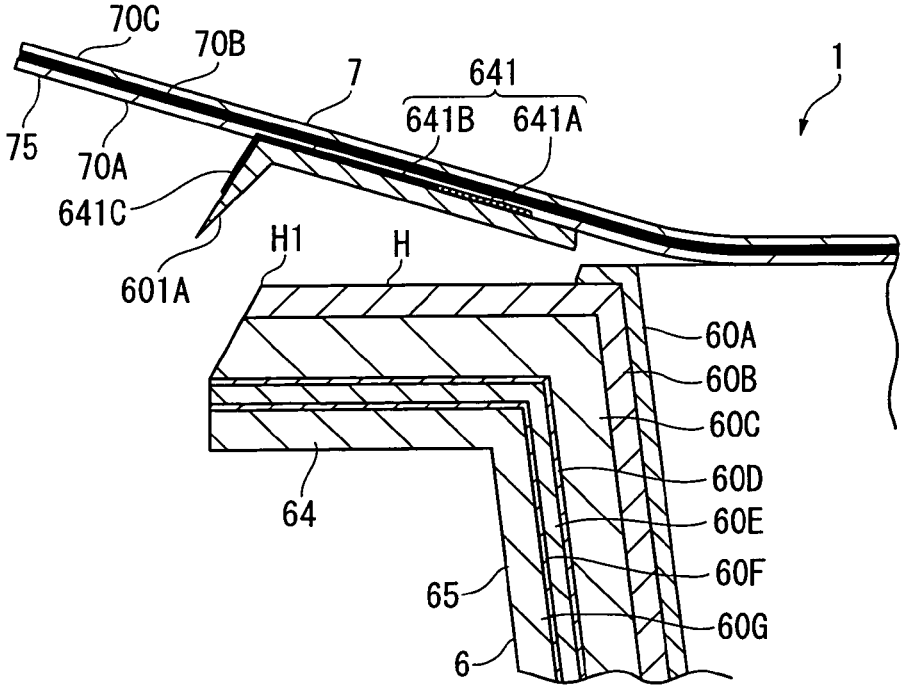
FIG. 7 is an illustration showing how the packaging body is opened.

In order to open the easy-open packaging body 1, first, the opening tab 75 is gripped to peel off the lid 7, as shown in FIG. 7. At this time, a stress transmitted from the opening tab 75 is transmitted to the protruding seal part 641C. Then, in the first layer 60A, only a part on the outer circumferential side of the notch 64A of the flange 64 (including the end 601A) is peeled off at an interface between the first layer 60A and the second layer 60B with the part adhering to the lid 7.

The peeling strength between the first layer 60A and the second layer 60B is preferably 15 N/15 mm or smaller, more preferably, 3 to 15 N/15 mm. When the peeling strength exceeds 15 N/15 mm, it becomes difficult to peel off the first layer 60A from the second layer 60B, which degrade easy-open performance.

On the other hand, the peeling strength between the lid 7 and the heat-seal part 641 of the first layer 60A requires to be greater than the peeling strength between the first layer 60A and the second layer 60B, which should be 20 N/15 mm or greater, preferably 25N/15 mm or greater. When the peeling strength is smaller than 20 N/15 mm, the easy-open performance between the first layer 60A and the second layer 60B might not be ensured.

In the present embodiment, although the end 601A of the first layer 60A is peeled off with the lid 7, since the tip of the end 601A in the extending direction is thin, the end 601A might be cut due to the force applied in peeling off the lid 7. In other words, the tip of the end 601A might not be peeled off from an end surface of the third layer 60C, but be remained on the end surface of the third layer 60C.

Steps for manufacturing the easy-open packaging body 1 as described above will be described below referring to FIG. 8. A manufacturing method of the easy-open packaging body 1 according to the present invention can be exemplified by, for instance, a system in which steps from sheet molding to content filling are performed continuously (Form Field Seal System). Specifically, the system includes a sheet molding step for manufacturing the multilayer sheet 2, a container body molding step for molding the container body 65, a die-cutting step for die-cutting the outer circumference of the flange 64 by actuating a later-described cutting die 92 (FIG. 8) from a side opposite to the first layer 60A of the multilayer sheet, a lid molding step for molding the lid 7, a filling step for filling the molded container 6 with a content such as food and a heat-seal step for heat-sealing the container 6 filled with the content and the lid 7.

Figure 8:
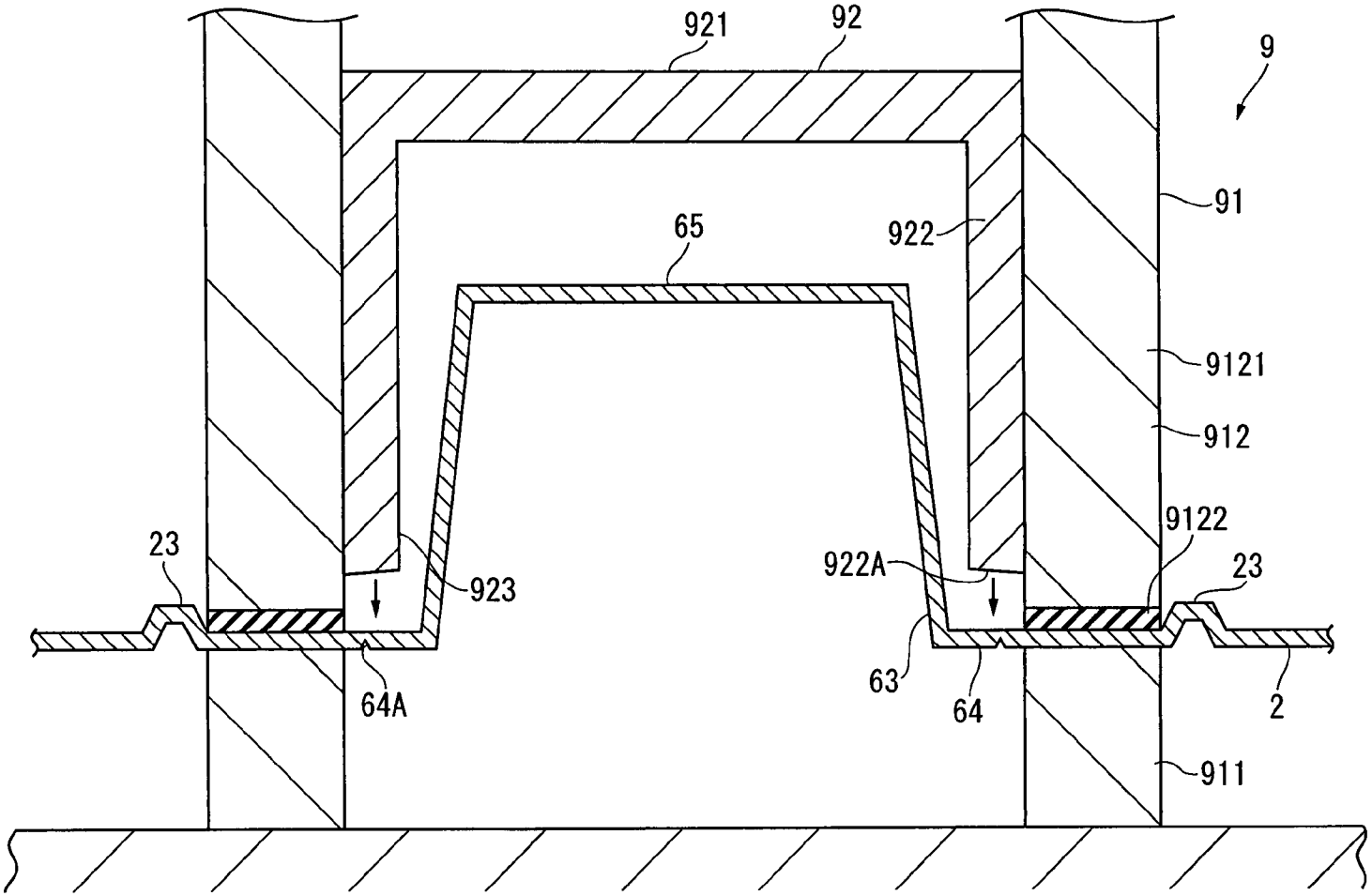
FIG. 8 is a schematic view showing a die cutter used in the embodiment.

First, the multilayer sheet 2 including seven layers is manufactured by T-die coextrusion or the like (sheet molding step). Then, although not shown, the multilayer sheet 2 is pre-stretched using a plug in a cavity having a shape corresponding to the profile of the container body 65, and then, the container body 65 is formed from the multilayer sheet 2 by a plug assist molding employing air-pressure molding or vacuum molding. At this time, as shown in FIG. 8, a sheet positioning part 23 for positioning is molded on the outer side of the part corresponding to the flange 64. The sheet positioning part 23 protrudes toward a part corresponding to the bottom side 61 of the container body 65 (container body molding step).

Next, the notch 64A for opening is formed. Specifically, the notch 64A is formed by pressing a stamping die (not shown) having a ringed blade onto the upper surface of the part corresponding to the flange 64. Examples of the ringed blade include a metal blade, a heat blade provided with a heating function and the like.

Next, the multilayer sheet 2 is die-cut at the outer side of the part corresponding to the flange 64. Here, a die cutter 9 used in the die-cutting step will be described.

As shown in FIG. 8, the die cutter 9 includes a sheet holder 91 for holding the multilayer sheet 2 (having been molded into the container body 65) from the both sides thereof at the outer side of the part corresponding to the flange 64 and the cutting die 92 that is moved closer to the flange 64 from the side opposite to the first layer 60A of the multilayer sheet 2 being held by the sheet holder 91 to die-cut the outer side of the flange 64.

The sheet holder 91 is fixed on an install table or the like, the sheet holder 91 including a sheet support table 911 for supporting the multilayer sheet 2 at the outer side of the part corresponding to the flange 64 from the lower side, a die guide 912 that is disposed on the upper side of the sheet support table 911 and sandwiches the multilayer sheet 2 at the outer side of the part corresponding to the flange 64 with the sheet support table 911.

The sheet support table 911 is a metal ringed member having a substantially circular cross section with an inner surface corresponding to an outer circumferential surface of the cutting die 92.

The die guide 912 can vertically move close to and away from the sheet support table 911, the die guide 912 including a guide body 9121 as a metal ringed member having a substantially circular cross section and a biasing part 9122 provided along an outer circumferential end of the guide body 9121 on the sheet support table 911 side.

An inner surface of the guide body 9121 corresponds to the outer circumferential surface of the cutting die 92.

The biasing part 9122 is formed by a biasing member such as rubber.

Note that the inner and outer diameters of the sheet support table 911 and the die guide 912 are substantially equal.

The cutting die 92 is a metal container-shaped member, which die-cuts the multilayer sheet 2 at the outer side of the part corresponding to the flange 64. The cutting die 92 includes a circular bottom side 921 and a cylindrical lateral side 922 that is upright from and integrated with the bottom side 921, and a circular opening 923 is formed on a plane facing the bottom side 921.

The cutting die 92 is disposed on the inner side of the sheet holder 91, the outer diameter of the cutting die 92 being substantially equal to that of the flange 64 of the container 6. The inner diameter of the cutting die 92 is larger than the diameter of the opening 63 of the container 6 and smaller than the outer diameter of the flange 64.

An end surface 922A on the opening 923 side of the lateral side 922 is inclined downward from an inner edge of the opening toward an outer edge thereof. Thus, when the multilayer sheet 2 is die-cut, the multilayer sheet 2 is sandwiched between the outer edge of the end surface 922A of the lateral side 922 and an inner edge of the upper side of the sheet support table 911, so that the multilayer sheet 2 is cut at the outer circumferential side of the flange 64.

The die-cutting step is performed as follows using the die cutter 9 as described above.

First, as shown in FIG. 8, the sheet positioning part 23 of the multilayer sheet 2 is brought into contact with an outer edge of the sheet support table 911 to position a setting position of the multilayer sheet 2, and the multilayer sheet 2 is set on the sheet support table 911 with the opening 63 of the container body 65 being faced downward.

Next, the die guide 912 is moved closer to the multilayer sheet 2 from the upper side of the multilayer sheet 2 set on the sheet support table 911, so that the biasing part 9122 contacts with the seventh layer 60G side (on the side opposite to the first layer 60A) of the multilayer sheet 2 to bias the multilayer sheet 2. Then, the sheet support table 911 and the die guide 912 sandwich and support the multilayer sheet 2 at the outer side of the part corresponding to the flange 64 from both sides (the seventh layer 60G side and the first layer 60A side) of the multilayer sheet 2.

Then, the cutting die 92 is moved downward from the die guide 912 side, namely, from the upper side of the supported multilayer sheet 2 (the seventh layer 60G side) to die-cut the outer side of the part corresponding to the flange 64 of the multilayer sheet 2, thereby obtaining the container 6 (die-cutting step).

Next, the molded container 6 is filled with the content such as food from the opening 63 using a known filling device, packing device or the like (filling step).

Further, the lid 7 that has been formed by cutting a resin sheet into a shape and a size according to the flange 64 of the container 6 is heat-sealed to the flange 64 of the container 6.

A heat-seal device used to heat-seal the lid 7 and the container 6 is a widely-used one, which includes a seal bucket for receiving the container 6, a lid feeder for feeding the sheet-shaped lid 7, and a heat-seal ring moving vertically for sealing the lid 7 and the flange 64 of the container 6 (all not shown).

Although not shown, the heat-seal ring includes a first heat-seal ring for forming the first seal part 641A that is formed to enclose the opening 63 of the container 6 and a second heat-seal ring for forming the second seal-part 641B.

First, the heat-sealing of the lid 7 and the flange 64 is performed using the first heat-seal ring having a large width, and then the heat-sealing using the second heat-seal ring is performed.

The heat-seal temperature is preferably 160 to 220° C. The heat-seal time is around 1.5 seconds (heat-seal step).

The easy-open packaging body 1 is manufactured as described above.

According to the present embodiment, the following advantages can be obtained.

(1) Since the end 601A of the first layer 60A extends over the edge H1 of the peeled surface H toward the bottom side 61 of the container, the edge H1 of the peeled surface H is not exposed on the outer end surface of the flange 64. Thus, in heat-sealing the lid 7 to the flange 64, even when the seal resin is melted and flowed to the end surface of the flange 64, the resin does not adhere to the edge H1 of the peeled surface H1. Therefore, degradation of the opening performance due to the melted and flowed seal resin can be prevented, thereby ensuring the easy-open performance.

(2) Since the easy-open performance can be ensured even when the seal resin is deposited to the end surface of the flange 64, the heat-sealing can be performed with high temperature and high pressure, thus ensuring the high sealing performance.

(3) The extending dimension of the end 601A of the first layer 60A of the flange 64 is no less than 1.2 times as large as the distance between the upper surface of the first layer 60A and the upper surface of the peeled surface H, thereby securely preventing the seal resin from adhering to the edge H1 of the peeled surface H.

Also, in the present embodiment, since the end 601A of the first layer 60A extends to reach the third layer 60C, even when a great amount of the seal resin is melted and flowed to the end surface of the flange 64, the seal resin only adheres to the outer surface of the end 601A of the first layer 60A and the seal resin can be prevented from adhering to end surfaces of other layers, which ensures the easy-open performance.

(4) Since the notch 64A is formed on the first layer 60A of the flange 64, the first layer 60A on the outer circumferential side of the notch 64A can be easily peeled off with the lid 7 in opening the lid 7, which also ensures the easy-open performance.

(5) When the inner pressure of the packaging body 1 becomes high, the stress concentrates on an inner circumferential part (an inner circumferential part of the first seal part 641A) of the heat-seal part 641 of the lid 7 and the flange 64 of the container 6. However, since the inner circumferential part of the first seal part 641A is formed on the outer circumferential side of the notch 64A of the flange 64 with the space of 0.2 mm or more, the stress is hardly applied to the notch 64A. Therefore, the packaging body 1 with excellent pressure resistance can be obtained.

(6) Since the flange 64 of the container 6 and the lid 7 are welded by the first seal part 641A and the second seal part 641B formed within the area of the first seal part 641A, the high sealing performance of the packaging body 1 can be ensured.

(7) Since the second seal part 641B is melted and flowed to the outer surface of the end of the end 601A of the first layer 60A of the flange 64 at a position corresponding to the opening tab 75, and the second seal part 641B is formed within the area of the first seal part 641A, a force in opening is transmitted to the area of the first seal part 641A, allowing the lid 7 to be easily opened.

(8) Since the protruding seal part 641C of the second seal part 641B is formed only at a position corresponding to the opening tab 75 of the lid 7, the lid 7 does not open from a part other than the opening tab 75.

(9) In the manufacturing steps of the container 6, the cutting die 92 is disposed on the seventh layer 60G side of the multilayer sheet 2 at the part corresponding to the flange 64, and the sheet support table 911 is disposed on the outer side of the flange 64. By die-cutting the multilayer sheet 2 from the seventh layer 60G side with the cutting die 92 and the sheet support table 911 being disposed as described above, the end 601A of the first layer 60A can be extended toward the bottom side 61 side of the container.

Also, the end 601A of the first layer 60A is extended simultaneously with the die-cutting and thus an additional step for extending the end 601A is not required, thus facilitating the manufacturing step of the container 6.

(10) Since the part corresponding to the opening 63 of the container body 65 formed by the multilayer sheet 2 is faced downward when the die-cutting is performed, the container 6 that is die-cut from the multilayer sheet 2 drops due to the self-weight. During the dropping, by replacing the multilayer sheet 2 with a new one formed into another container body 65 to perform die-cutting, the die-cutting step can be performed successively, thereby enhancing the manufacturing efficiency.

(11) By supporting the outer side of the part corresponding to the flange 64 of the multilayer sheet 2 and actuating the cutting die, the multilayer sheet 2 is not loosened, thereby accurately die-cutting the container.

When the outer side of the part corresponding to the flange 64 of the multilayer sheet 2 is supported, by biasing and supporting the multilayer sheet 2 from the side opposite to the first layer 60A, the supported part can be quickly released after die-cutting, which allows successive die-cutting and enhances manufacturing efficiency.

Incidentally, the scope of the present invention is not restricted to the embodiment described above, but includes modifications and improvements as long as an object of the present invention can be achieved.

Although the lid 7 and the first layer 60A are peeled off together by the layer peeling generated between the first layer 60A and the second layer 60B of the container 6 in the above-described embodiment, the second layer may be a resin layer causing the cohesive failure so that the second layer and the first layer may be peeled off with the lid by the cohesive failure generated within the second layer. In such case, an arrangement described below can be employed.

There may be conceived an arrangement where the first layer is also a resin layer causing the cohesive failure, and the cohesive failure strength of the second layer is smaller than that of the first layer. In this case, when the lid is peeled off, the stress concentrates on the second layer, and the cohesive failure is generated within the second layer to cause the first layer (Translator's comment: correctly, the second layer and the first layer) to be peeled off with the lid.

Similarly, the first layer may be a resin layer causing the cohesive failure, so that, when the lid 7 is opened, the cohesive failure is generated within the first layer to cause the first layer to be peeled off with the lid 7.

Herein, as the layer causing the cohesive failure, there can be exemplified a layer containing a polyolefin resin, an elastomer with modulus of elasticity of, for instance, 200 MPa or smaller, preferably 150 MPa or smaller, and a flexible resin or a non-compatible resin. The flexible resin and the elastomer are preferably contained in a polyolefin resin composition by around 3 to 50 wt %.

As the flexible resin, for instance, ethylene-polar vinyl compound copolymer can be exemplified. For instance, there can be exemplified an ethylene-acrylic acid copolymer (EAA), an ethylene-methylacrylate copolymer (EMA), an ethylene-methacrylic acid copolymer (EMAA), ethylene-methylmethacrylate copolymer (EMMA), an ethylene-ethylacrylate copolymer (EEA), an ethylene-ethylacrylate-maleic acid anhydride copolymer (EEA-MAH), a known ethylene-acrylic acid copolymer such as an ionomer resin, an ethylene-polyvinyl acetate copolymer and a styrene graft polypropylene.

Examples of the elastomer include an olefin elastomer (e.g. copolymer of amorphous ethylene and $\alpha$-olefin such as propylene and butane, with density of 900 kg/m$^3$ or smaller), a styrene elastomer (a styrene-butadiene block copolymer, a styrene-butadiene random copolymer, etc.) and a hydrogenated material of the above.

There is no limitation for the polyolefin resin, examples of which include polypropylene resins such as a homopolypropylene, a random polypropylene and a block polypropylene, and polyethylene resins such as a high-density polyethylene, a high-pressure process low-density polyethylene and a straight-chain low-density polyethylene.

Although the container 6 is molded from the multilayer sheet 2 having seven layers in the above-described embodiment, any multilayer sheet can be employed as the multilayer sheet 2 as long as a peeled surface is formed when the lid 7 is peeled off, namely a multilayer sheet including a peeled surface on an inner layer.

Although the lid 7 is formed by a sheet including three layers of the sealant layer 70A, the adhesive resin layer 70B and the base material layer 70C in the above-described embodiment, the number of layers may be one or four or more.

Although the lid 7 includes the opening tab 75 in the above-described embodiment, the opening tab may not be provided. With the arrangement, the shape of the lid may be further simplified. Although the heat-seal part 641 of the lid 7 and the container 6 includes two sealing stages of the first seal part 641A and the second seal part 641B in the above-described embodiment, the heat-seal part may include a single sealing stage. Since the container 6 of the present invention can be heat-sealed to the lid 7 with high temperature and high pressure, sufficient sealing performance can be obtained even with the single sealing stage.

Although the notch 64A of the flange 64 of the container 6 is formed in the above-described embodiment, the notch 64A may not be formed. In such case, the first layer 60A may be so arranged as to be cut at the edge when the lid 7 is peeled off.

Although the end 601A of the first layer 60A extends to reach the end surface of the third layer 60C in the above-described embodiment, the arrangement is not limited thereto as long as the end 601A extends over the peeled surface H toward the bottom side 61.

In the die-cutting step of the above-described embodiment, the multilayer sheet 2 molded into the container body 65 is supported with the first layer 60A (i.e. the opening 63) of the container 6 being faced downward, and the cutting die 92 is moved downward from the upper side of the supported multilayer sheet 2 to perform the die-cutting, but the arrangement is not limited thereto. For instance, the multilayer sheet 2 may be die-cut by moving the cutting die 92 horizontally, or the sheet support table 91 (Translator's comment: correctly, sheet support table 911) may be moved from the lower side to the upper side while fixing the cutting die 92 to perform the die-cutting.

Specific structure and shape of the components in the present invention may be designed in any manner as long as an object of the present invention can be achieved.

The present invention will further be described below with reference to examples and comparisons.

Example

First, the multilayer sheet 2 having seven layers was molded by coextrusion molding using resins described below as raw resins of the multilayer sheet 2 used for molding the container 6.

[1] First Layer 60A (Innermost Layer)

[1-1] Raw resin: polyethylene (HDPE-445M manufactured by Idemitsu Petrochemical Co., Ltd.)

[1-2] Layer thickness: 80 μm

[2] Second Layer 60B (Adjacent Layer)

[2-1] Raw resin: 80 wt % of polypropylene (E-105GM manufactured by Idemitsu Petrochemical Co., Ltd.) and 20 wt % of polyethylene (LDPE-fz-038 manufactured by Mitsubishi Corporation).

[2-2] Layer thickness: 180 μm

[3] Third Layer 60C (Base Material Layer)

[3-1] Raw resin: polypropylene (E-105GM manufactured by Idemitsu Petrochemical Co., Ltd.)

[3-2] Layer thickness: 350 μm

[4] Fourth Layer 60D

[4-1] Raw resin: modified polyolefin adhesive resin (ADMER QF-500 manufactured by Mitsui Chemicals, Inc.)

[4-2] Layer thickness: 10 μm

[5] Fifth Layer 60E

[5-1] Raw resin: ethylene vinyl alcohol resin (EVAL manufactured by KURARAY CO., LTD.)

[5-2] Layer thickness: 70 μm

[6] Sixth Layer 60F

[6-1] Raw resin: modified polyolefin adhesive resin (ADMER QF-500 manufactured by Mitsui Chemicals, Inc.)

[6-2] Layer thickness: 10 μm

[7] Seventh Layer 60G (Container Outer Layer)

[7-1] Raw resin: polypropylene (E-105GM manufactured by Idemitsu Petrochemical Co., Ltd.)

[7-2] Layer thickness: 200 μm

The multilayer sheet 2 having seven layers with the above-described arrangement was formed into the container body 65 to obtain the container 6 by the same method as in the above-described embodiment. Specifically, the multilayer sheet 2 was so set that the opening 63 of the container body 65 was faced downward, and the cutting die 92 was moved downward from the seventh layer 60G side to die-cut the multilayer sheet 2, and the container 6 was obtained.

Next, a lid (thickness: 100 μm) was manufactured. Although the lid had a shape similar to that of the lid 7 of the above-described embodiment, a layer structure thereof was different as follows.

[1] Base Material Layer

[1-1] Raw resin: polyethylene terephthalate (PT4274 manufactured by DU PONT-MITSUI POLYCHEMICALS CO., LTD.)

[1-2] Layer thickness: 16 μm

[2] Adhesive Layer

[2-1] Raw resin: modified polyolefin adhesive resin (ADMER QF-500 manufactured by Mitsui Chemicals, Inc.)

[2-2] Layer thickness: 10 μm

[3] Gas Barrier Layer

[3-1] Rae resin: ethylene vinyl alcohol resin (EVAL manufactured by KURARAY CO., LTD.)

[3-2] Layer thickness: 14 μm

[4] Adhesive Layer

[4-1] Raw resin: modified polyolefin adhesive resin (ADMER QF-500 manufactured by Mitsui Chemicals, Inc.)

[4-2] Layer thickness: 10 μm

[5] Sealant Layer

[5-1] Raw resin: polyethylene (L-LDPE-0238CL manufactured by Idemitsu Petrochemical Co., Ltd.)

[5-2] Layer thickness: 50 μm

The lid as described above was heat-sealed to the container 6 so that the sealant layer contacts with the first layer 60A of the flange 64. The heat-sealing had two sealing stages (constituted by the first seal part 641A and the second seal part 641B) as in the above-described embodiment, and the width of the first seal part 641A was 5 mm and the heat-seal time was 1.5 seconds. Heat sealing temperatures were 160° C., 170° C., 180° C., 190° C., 200° C., 210° C. and 220° C.

[Comparison]

Figure 9:
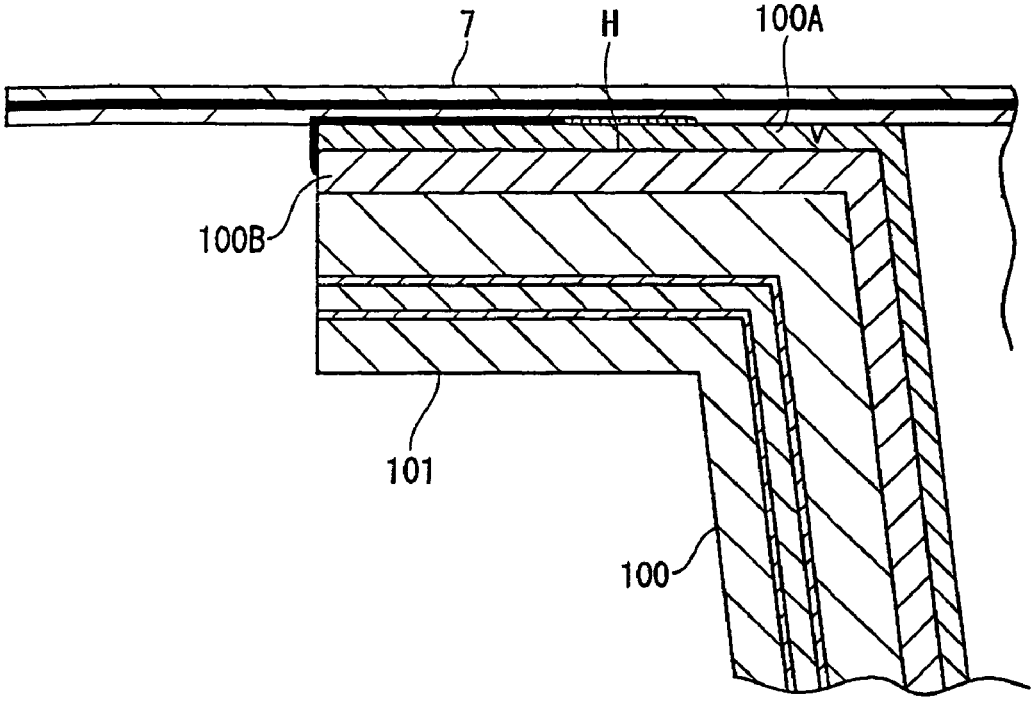
FIG. 9 PRIOR ART
FIG. 9 is a cross section showing a prior art.

A container 100 (see FIG. 9) was obtained by molding the multilayer sheet 2 having seven layers that were obtained using the same raw resins as those in the example. Although the size and shape of the container 100 was substantially the same as the container 6 of the example, a method for die-cutting the multilayer sheet 2 was different. Specifically, in the comparison, the opening 63 was faced upward and the cutting die was moved downward from the first layer 60A side to die-cut the multilayer sheet 2.

In addition, the same lid as in the example was heat-sealed to a flange 101 of the container 100 under the same condition as the example.

[Evaluation Method]

In the example and the comparison, the packaging body heat-sealed with each of the heat-seal temperatures was opened from the opening tab of the lid to evaluate the opening performance. Table 1 below shows the evaluation result.

TABLE 1

| | Heat-Seal Temperature (° C.) | | | | | | |
|---|---|---|---|---|---|---|---|
| | 160 | 170 | 180 | 190 | 200 | 210 | 220 |
| Example | x | ○ | ○ | ○ | ○ | ○ | ○ |
| Comparison | x | ○ | ○ | ○ | ○ | x | x |

In Table 1, ○ shows that the opening performance was good, while x shows that the lid could not be opened.

Table 1 shows that the opening performance in the example was good under the conditions other than 160° C., and the opening performance was good even when the packaging body was heat-sealed with high temperature of 210° C. or higher. On the other hand, the opening performance in the comparison was good only under the conditions between 170° C. and 200° C. That is to say, in the example, since the seal resin adhered to the edge of the peeled surface H (see FIG. 9) when the heat-sealing was performed with temperature of 210° C. or higher, the opening became difficult.

From the evaluation result, in the example, it was verified that the easy-opening performance could be ensured even when the heat-sealing was performed with high temperature.

INDUSTRIAL APPLICABILITY

The present invention relates to a container that is molded from a multilayer sheet, the container satisfying both the sealing performance and the easy-open performance, a packaging body including the container, and a manufacturing method of the container, and the invention can be applied to packaging of various kinds of foods such as jelly and pudding.

The invention claimed is:

1. A packaging body, comprising:

a container that is molded from a multilayer sheet having a peeled surface on an inner layer, the container including an opening from which a content is filled and a flange extending outward from a circumference of the opening; and a lid that is welded to the flange of the container, wherein on an outer end surface of the flange, an end of an innermost layer disposed on an inner side of the container including an upper surface of the flange extends over and covers an end of an adjacent layer adjacent to the innermost layer and formed on the flange toward a bottom side of the container; and a seal resin welding the lid to the flange is melted and flowed to an outer surface of the end of the innermost layer at least on an opening part of the lid.

2. A packaging body, comprising:

a container that is molded from a multilayer sheet having a peeled surface on an inner layer, the container including an opening from which a content is filled and a flange extending outward from a circumference of the opening; and a lid that is welded to the flange of the container, wherein on an outer end surface of the flange, an end of an innermost layer disposed on an inner side of the container including an upper surface of the flange extends over and covers an end of an adjacent layer adjacent to the innermost layer and formed on the flange toward a bottom side of the container, the lid includes an opening tab, the flange of the container and the lid are welded by a first seal part having a predetermined width and formed to enclose the opening and a second seal part formed within an area of the first seal part to enclose the opening along the first seal part, the second seal part having a width narrower than that of the first seal part, and a seal resin of the second seal part is melted and flowed to the outer surface of the end of the innermost layer of the flange at a position corresponding to the opening tab of the lid.

3. A manufacturing method of a container that is molded from a multilayer sheet, the container including a container body having an opening from which a content is filled; and a flange extending outward from a circumference of the opening of the container body with a peeled surface being formed, the method comprising:

forming the container body from the multilayer sheet; and setting a cutting die on a surface opposite to an innermost layer located on an inner side of the container body, and die-cutting the multilayer sheet at an outer circumference of a part corresponding to the flange so that on an outer end surface of the flange, an end of the innermost layer disposed on the inner side of the container including an upper surface of the flange extends over and covers an end of an adjacent layer adjacent to the innermost layer and formed on the flange toward a bottom side of the container.

4. The manufacturing method of the container according to claim 3, wherein an outer side of the part corresponding to the flange of the multilayer sheet is supported and the cutting die is actuated.

5. The manufacturing method of the container according to claim 4, wherein when the outer side of the part corresponding to the flange of the multilayer sheet is supported, the part is supported by biasing from a side opposite to the innermost layer.

6. The manufacturing method of the container according to claim 3, wherein the opening of the container body formed from the multilayer sheet is faced downward and the cutting die is moved downward to die-cut the container body.

* * * * *